United States Patent [19]

Clements et al.

[11] 4,351,090

[45] Sep. 28, 1982

[54] SPRING CLIP FOR WELLHEAD SLIPS

[75] Inventors: Gary B. Clements, Bixby; Robert E. Ramsey, Owasso, both of Okla.

[73] Assignee: Hinderliter Energy Equipment Corp., Tulsa, Okla.

[21] Appl. No.: 202,635

[22] Filed: Oct. 31, 1980

[51] Int. Cl.[3] ..... E21B 43/00; E21B 3/00

[52] U.S. Cl. ..... 24/263 D; 24/263 DT

[58] Field of Search ..... 24/263 D, 263 DT, 263 SB, 24/263 SW, 263 CA, 263 DC; 285/140, 141, 145

[56] References Cited

U.S. PATENT DOCUMENTS

| | | | |
|---|---|---|---|
| 1,079,689 | 11/1913 | Bowler et al. | 285/140 |
| 1,547,543 | 7/1925 | Welty | 24/263 DT |
| 2,143,615 | 1/1939 | Abegg | 24/263 DC |
| 2,689,139 | 9/1954 | Jones et al. | 24/263 DC |
| 2,874,437 | 2/1959 | Anderson | 24/263 DC |
| 4,275,487 | 6/1981 | Gray et al. | 24/263 DC |

*Primary Examiner*—Paul J. Hirsch

*Attorney, Agent, or Firm*—William S. Dorman

[57] ABSTRACT

A wellhead slip formed from a plurality of slip segments adapted to be arranged in a closed circular fashion around a tubular member so as to form a plurality of vertical gaps all but one of which are defined as "hinge" gaps, the remaining gap being defined as an "opening" gap, the slip segments being provided with aligned circumferential grooves constituting, in effect, a peripheral groove for the complete slip. A hinge yoke is received in the circumferential grooves in the area of each hinge gap and spanning the hinge gap, each hinge yoke being provided with a notch adjacent each of its opposite ends and facing outwardly from the groove. A hinge pin passes through holes above and below the groove in the area of each notch whereby the notches are received behind the hinge pins and whereby all of the slip segments can be moved hingedly outwardly from the closed circular position by opening at the opening gap. A spring clip is received in the ends of the circumferential grooves of the adjacent segments in the area of the opening gap and is provided with a vertical width slightly less than the width of the grooves. A pair of latch pins are received in holes above and below the groove in the slip segments on opposite sides of the opening gap. The spring clip has a closed loop adapted to be received around one of the latch pins adjacent the opening gap and a resilient catch spaced from the closed loop for engagement around and behind the other of the roll pins adjacent the opening gap. A finger is attached to the resilient catch to permit bending of the catch away from the other of the latch pins for releasing the catch to permit opening of the slip segments.

2 Claims, 5 Drawing Figures

SPRING CLIP FOR WELLHEAD SLIPS

BACKGROUND OF THE INVENTION

1. Field of the Invention

The present invention relates to wellhead slips of the type made from hinged slip segments, and more particularly to a wellhead slip where the end slip segments are held together by means of a spring clip.

2. Prior Art

In the past, wellhead slips for tubing, casing and the like have been made from slip segments which are ultimately placed in closed configuration around the tubing or casing. Sometimes, certain of the slip segments are connected to each other by hinges. Generally, the slip segments are held together around the tubing or casing by means of a wire snap ring which is received in a circumferential groove passing around all of the slip segments. When it is desired to remove the slip from the tubing or casing, it is first necessary to remove the snap ring which is sometimes a clumsy operation.

SUMMARY OF THE INVENTION

The present invention provides an improved wellhead slip which is made from a plurality of slip segments held together by hinges. Depending upon the size of the slip, it can be made from three or four or more segments which are designed to be arranged in circular fashion around a tubing, pipe or casing. After the slip has been so disposed about the tubing or pipe, etc., it is then placed within a slip seat or head. The lower portions of the slip segments, and hence the lower portion of the ultimate slip, form a tapered or conical surface. The slip seat or head is also provided with a corresponding tapered conical surface. Thus, the slip seat will hold the assembly and tubing or pipe in position by virtue of the wedging action between the conical surface of the slip and the tapered surface of the slip seat. The wickers or teeth, usually hardened, on the slip will bite into the tubing or pipe as a result of the aforementioned wedging action and therefore grip the pipe in the slip. The above described wedging action is conventional and, therefore, details of the tubing, pipe or casing and/or the slip seat or head are not shown herein.

The wellhead slip specifically described herein is particularly designed for use in connection with tubing and, therefore, is somewhat smaller than a corresponding slip which would be designed for use in connection with casing or larger pipe. Accordingly, the slip is described herein in terms of three slip segments. It should be understood, however, that four or more slip segments could be employed within the purview of the present invention if a larger slip is desired.

At any event, each slip segment of the present invention is provided with an upper, outer cylindrical portion and a lower, tapered or conical surface. In the closed position (when the slip is placed around a tubing, for example) small vertical spaces or gaps are provided between the adjacent ends of the segments. A circumferential groove is provided in the cylindrical portions of the segments and two hinges are provided in the areas of two of these gaps. Each hinge comprises a hinge yoke in the form of a flat piece of steel having a thickness slightly less than the width of the circumferential groove. Each hinge yoke is provided with a notch adjacent each end. Roll pins pass through suitable holes in the slip segments above and below the recesses so as to be received within the notches of each hinge yoke.

As the slip segments are opened outwardly, the engagement of the roll pins in the notches of the hinge yokes will provide a hinge action.

With regard to the remaining gap (the gap which is not provided with a hinge) a spring clasp or clip is provided. This spring clip cooperates with another pair of roll pins which are received in suitable holes above and below the groove in the area of the third gap. The clasp, which is made of spring steel, is provided with a loop which surrounds one of the roll pins and a resilient nose or catch at the other end which is adapted to be received behind the other roll pin in the closed position. A finger connects with the catch portion of the clip so that application of pressure from a screwdriver, for example, inserted into the groove will permit bending of the finger to bend the catch away from the roll pin to permit opening of the spring clip.

DETAILED DESCRIPTION OF THE PREFERRED EMBODIMENTS

Figure 1:
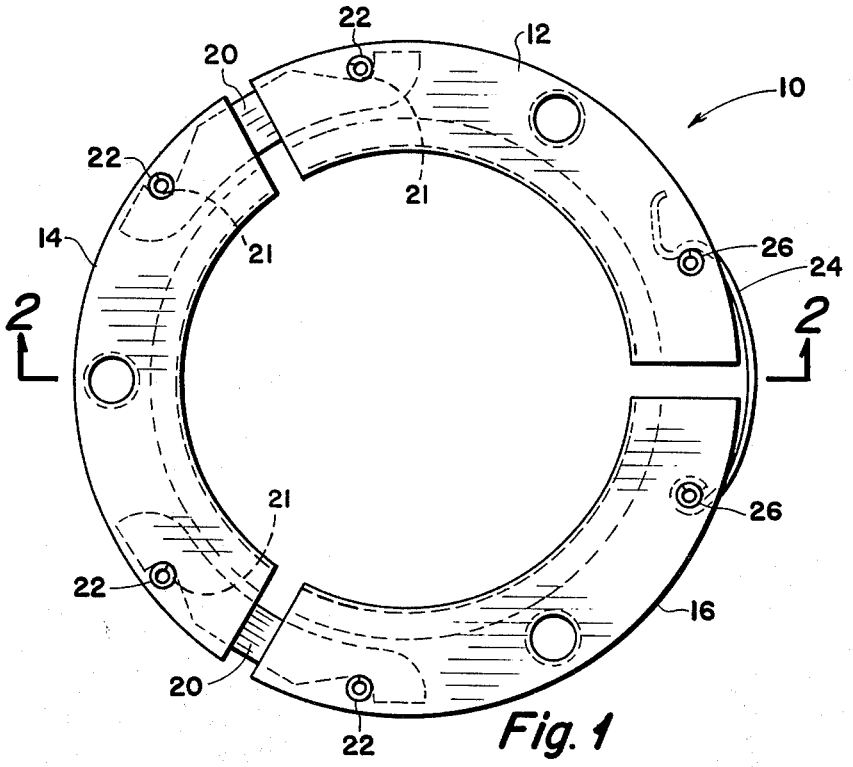
FIG. 1 is a top plan view of a wellhead slip with certain of the hidden parts shown in broken lines.
Figure 2:
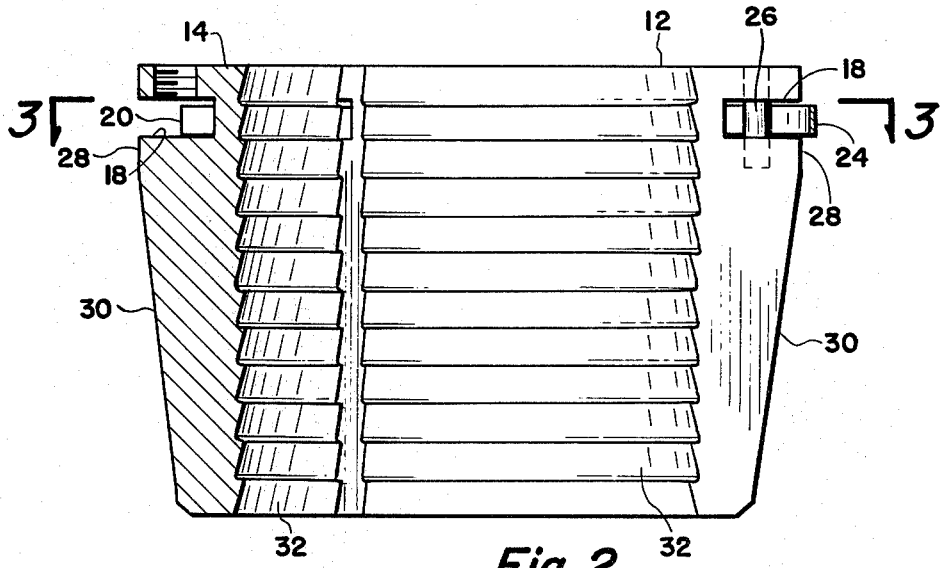
FIG. 2 is a sectional view taken along line 2—2 of FIG. 1.

Referring to the drawings in detail, FIG. 1 shows a wellhead slip 10 which comprises three slip segments 12, 14 and 16. Each segment is provided with a circumferential groove 18 adjacent the upper end thereof for a purpose which will hereinafter appear. A hinge yoke 20 is received in the recesses 18 of the slips 12 and 14 where they are adjacent each other. A small space or gap is provided between the ends of the segments as shown in FIG. 1 so that, when the segments are arranged in the closed configuration of FIG. 1, the outer and inner boundaries of the slip will be essentially circular. A second and identical hinge yoke 20 is received in the circumferential grooves 18 of the slip segments 14 and 16 and spans the joint or gap between these two slip segments as shown. For the sake of further explanation, the gaps between segments 12 and 14 and between segments 14 and 16 will be referred to as "hinge" gaps whereas the remaining gap between segments 12 and 16 will be referred to as the "opening" gap. Thus, the hinge yokes 20 connect adjacent slip segments to each other across the hinge gaps.

Figure 3:
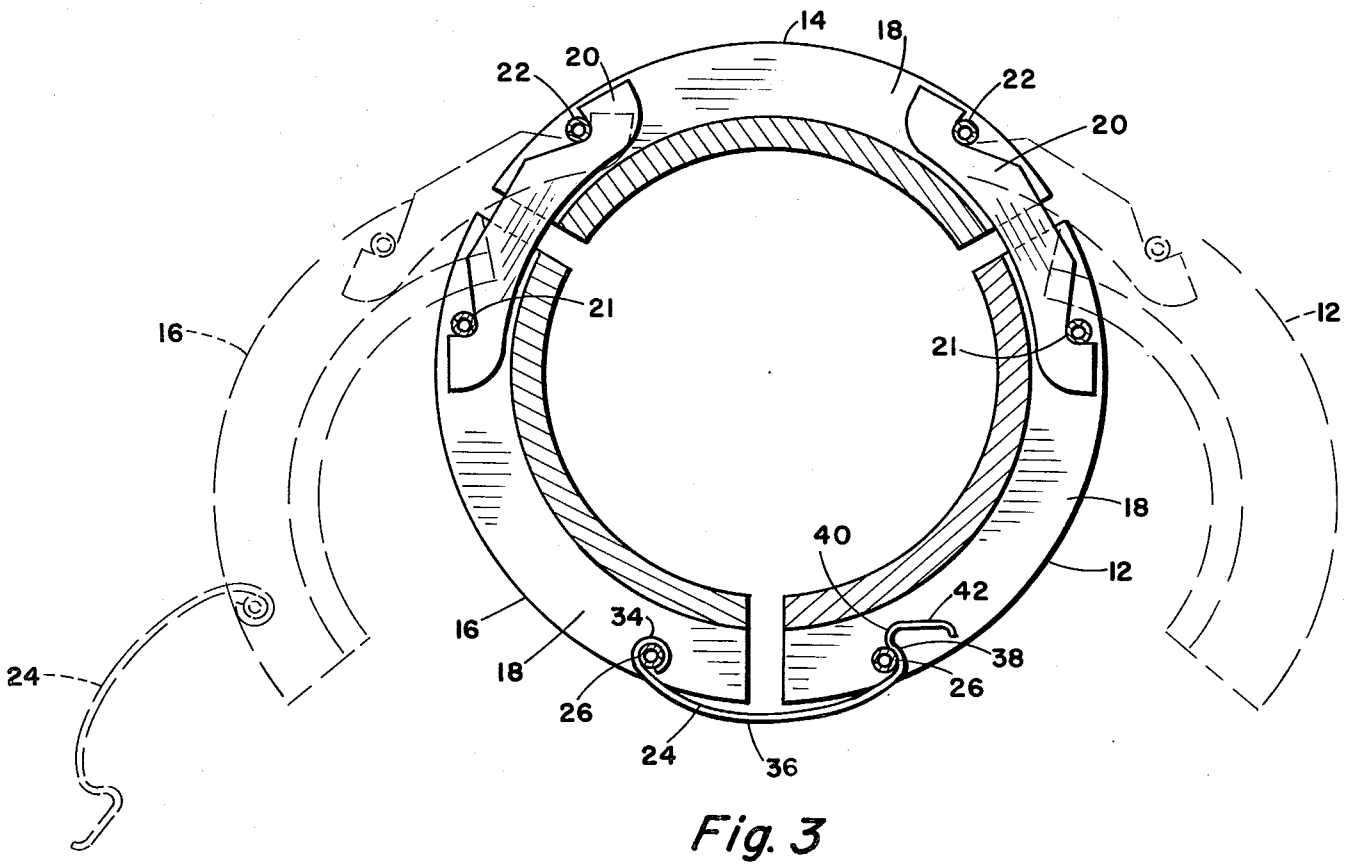
FIG. 3 is a sectional view taken along section lne 3—3 of FIG. 2 showing the open position of the slip in dashed lines.
Figure 4:
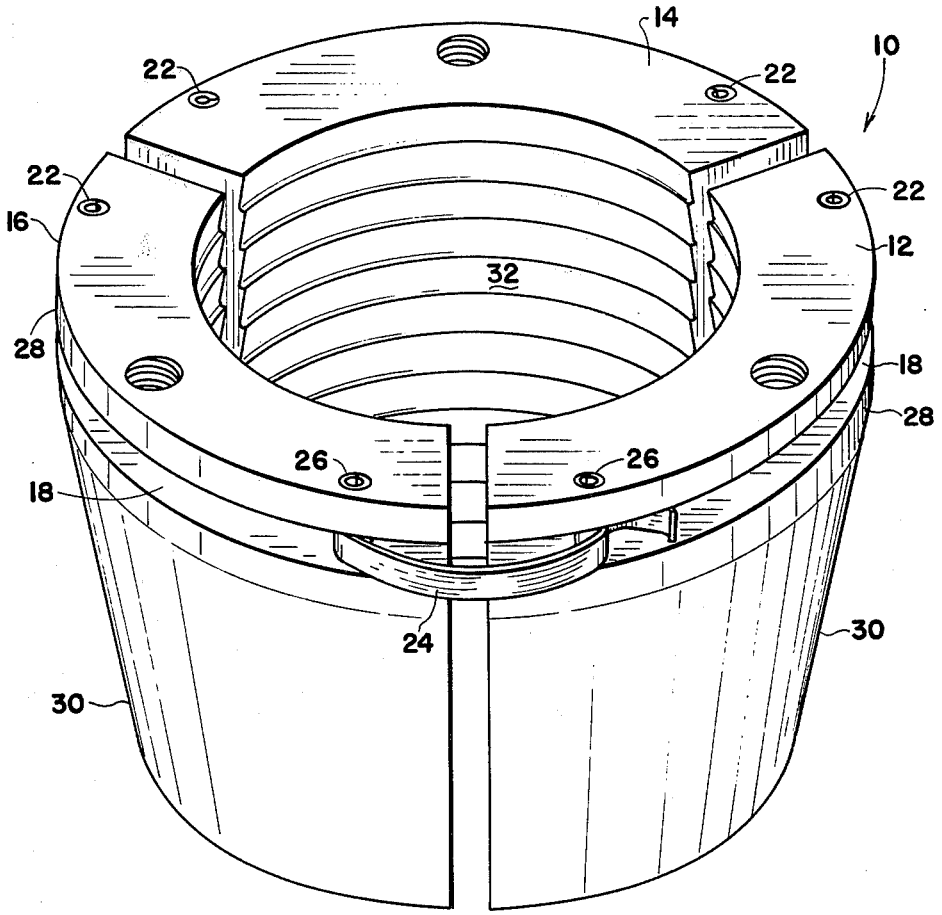
FIG. 4 is a perspective view of the wellhead slip.
Figure 5:
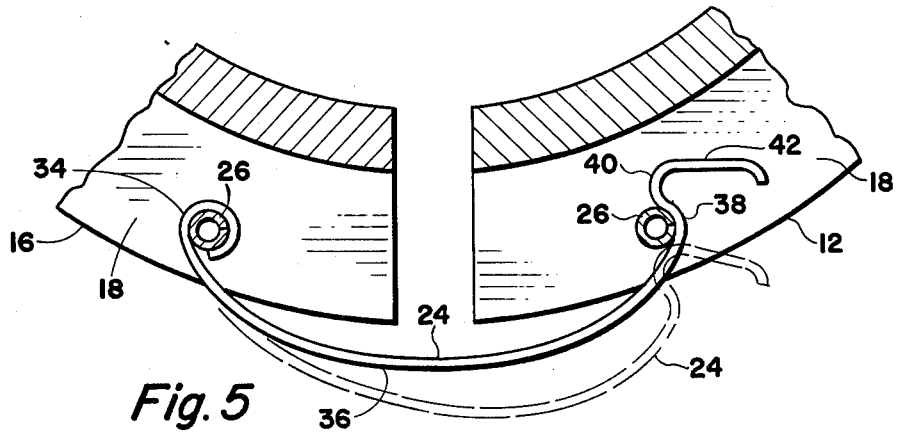
FIG. 5 is an enlarged fragmentary view of a portion of FIG. 3 showing details of the spring clip and showing the clip in open position by dashed lines.

As best shown in FIG. 3, each yoke 20 is in the form of a flat strip of steel provided with a notch 21 adjacent each end. The notches 21 open outwardly towards the outside of the slip. Roll pins 22 pass through suitable holes in the slip segments 12 and 14 above and below the recesses 18 so as to be received within the notches 21 of the yoke 20. Identical roll pins 22 are received in suitable holes in the slip segments 14 and 16 above and below the recesses 18 so as to be received within the notches 21 of the yoke 20 which connects between the slip segments 14 and 16. The roll pins 22 will be sometimes hereinafter referred to as "hinge" pins. The relationship between the hinge yokes 20 and the hinge pins 22 is such that, as shown in FIG. 3, the slip segments 12, 14 and 16 can be opened outwardly as shown in dotted lines in FIG. 3 to permit the removal from, and attachment around, a piece of tubing (not shown).

For the purpose of maintaining the slip segments in a closed position around the tubing (not shown), a spring clasp or clip 24 is provided to connect slip segments 12 and 16 to each other across the "opening" gap as will hereinafter appear. This spring clip, the details of which will be set forth in greater detail hereinafter, cooperates with another pair of roll pins 26 which are otherwise identical to the roll pins 22 and which are received in suitable holes above and below the recesses 18 of the segments 12 and 16 on opposite sides of the gap between these two slip segments. The roll pins 26 will be sometimes hereinafter referred to as "latch" pins.

The spring clip 24 is made of a piece of flat spring steel having a width slightly less than the height of the groove 18 and being provided with a closed loop 34 at one end adapted to be received around one of the latch pins 26. The central portion of the spring clip 24 is bowed as at 36, and the bowed portion connects with a curved portion 38 which is adapted to surround a portion of the other latch pin 26. The curved portion 38 merges with another curved portion 40 which is located behind the latch pin 26 (in relation to the bowed portion 36) and which is of reverse curvature with respect to the curved portion 38. The curved portion 40 connects with a finger portion 42 which constitutes the opposite end of the spring clip 24 from the closed loop 34. The curved portion 40 can be considered as resilient catch of locking nose.

Assuming that the spring clip 24 is in the open position; i.e. where the right hand end of the spring clip 24, as shown in FIG. 3, is out of engagement with the right hand latch pin 26, the spring clip 24 can be rotated in a counter-clockwise direction by pivoting or rotating the loop portion 34 about the left hand latch pin 26. When the curved portion or catch 40 contacts the right hand latch pin 26, further application of pressure against the spring clip 24 will cause the catch 40 to bend outwardly and move rearwardly until the curved portion 38 surrounds the right hand portion of the right hand latch pin 26 as shown in FIG. 3, at which time the catch 40 will snap into place behind the latch pin. If it is desired to disengage the spring clip 24 from the right hand latch pin 26, a screwdriver or other implement can be placed in the recess 18 of the slip segment 12 behind the finger 42; an outward bending of the finger 42 will release the catch 40 from engagement with the right hand latch pin 26 so as to permit the spring clip to pass beyond the latch pin so that the slip can be opened as shown in FIG. 3 in dotted lines.

The slip shown in the drawings has but three slip segments. For purposes of explanation only, it can be assumed that the slip shown in the drawings is intended for use in connection with tubing, although slips for wellhead casing can also be formed from slips having three segments. Generally, however, the slip segments for wellhead casing are larger and are usually formed from four segments in which case it will be necessary to provide three hinge yokes 20. The outer shape of the slip is essentially conventional. The upper portion of each slip segment is flat or cylindrical as at 28, whereas the lower portion is tapered or conical as at 30 and the inner surfaces are provided with wickers 32 for the purpose of engaging the tubing or casing in a manner well known.

Whereas the present invention has been described in particular relation to the drawings attached hereto, it should be understood that other and further modifications, apart from those shown or suggested herein, may be made within the spirit and scope of the invention.

What is claimed is:

1. A wellhead slip formed from a plurality of slip segments adapted to be arranged in a closed circular fashion around a tubular member so as to form a plurality of vertical gaps all but one of which are defined as hinge gaps, the remaining gap being defined as an opening gap, said slip segments being provided with aligned circumferential grooves consituting, in effect, a peripheral groove for the slip, a hinge yoke received in the circumferential grooves in the area of each hinge gap and spanning said hinge gap, each hinge yoke being provided with a notch adjacent each of its opposite ends and facing outwardly from said groove, a hinge pin passing through holes above and below said groove in the area of each notch whereby the notches are received inwardly behind said hinge pins and whereby all of the slip segments can be moved hingedly outwardly from the closed circular position by opening at the opening gap, an elongated spring clip received in the ends of the circumferential grooves of the adjacent segments in the area of the opening gap and having a vertical width slightly less than the width of the grooves, a pair of latch pins received in holes above and below said groove in said slip segments on opposite sides of said opening gap, said spring clip having a closed loop adapted to be received around one of said latch pins adjacent said opening gap and being provided with a resilient catch spaced from said closed loop for engagement around and inwardly behind the other of said latch pins adjacent said opening gap, a finge attached to said resilient catch to permit bending of said catch away from said other of said latch pins for releasing said catch to permit opening of said slip segments.

2. A wellhead slip as set forth in claim 1 wherein said slip segments are three in number, wherein there are two hinge yokes, wherein the upper portion of each slig segment forms a portion of a cylindrical surface, wherein the lower portion of each slip segment forms a tapered or conical surface and wherein said circumferential grooves are located in the cylindrical portions of said slip segments.

* * * * *